US006374509B1

(12) United States Patent
Jackson, Sr. et al.

(10) Patent No.: US 6,374,509 B1
(45) Date of Patent: Apr. 23, 2002

(54) SHOE HOLDER FOR ATTACHING A SHOE TO A DRYER

(76) Inventors: Richard W. Jackson, Sr.; Glenda M. Jackson, both of 712 N. Fiske Blvd., Cocoa, FL (US) 32922

( * ) Notice: Subject to any disclaimer, the term of this patent is extended or adjusted under 35 U.S.C. 154(b) by 0 days.

(21) Appl. No.: 09/641,855

(22) Filed: Aug. 18, 2000

(51) Int. Cl.[7] ..... F26B 25/00

(52) U.S. Cl. ..... 34/106; 34/104; 34/105; 34/600

(58) Field of Search ..... 34/103, 104, 105, 34/106, 107, 600, 216, 217

(56) References Cited

U.S. PATENT DOCUMENTS 2,864,180 A * 12/1958 Montgomery ..... 36/72 R
3,914,882 A * 10/1975 Greer ..... 36/62
4,702,016 A 10/1987 Grigsby et al.
4,813,641 A 3/1989 Wilson
5,024,408 A * 6/1991 Magee ..... 248/206.5
D335,008 S 4/1993 Abel
5,220,734 A * 6/1993 Carver ..... 34/133
5,519,949 A 5/1996 Gibson, Jr.
5,623,769 A * 4/1997 Hayden ..... 34/61
6,050,931 A * 4/2000 Russell ..... 600/15

* cited by examiner

*Primary Examiner*—Ira S. Lazarus
*Assistant Examiner*—Kathryn S. O'Malley

(57) ABSTRACT

A shoe holder for attaching a shoe to a dryer for preventing the tennis shoes from banging in the drum of the dryer while being dried. The shoe holder for attaching a shoe to a dryer includes a piece of material being adapted to fasten about a sole of a shoe; and also includes fastening members for fastening the piece of material about the sole of the shoe; and further includes dryer attachment members securely attached to the piece of material and being adapted to detachably attach to a drum of a dryer.

1 Claim, 2 Drawing Sheets

SHOE HOLDER FOR ATTACHING A SHOE TO A DRYER

BACKGROUND OF THE INVENTION

1. Field of the Invention

The present invention relates to a shoe pocket for a dryer and more particularly pertains to a new shoe holder for attaching a shoe to a dryer for preventing the tennis shoes from banging in the drum of the dryer while being dried.

2. Description of the Prior Art

The use of a shoe pocket for a dryer is known in the prior art. More specifically, a shoe pocket for a dryer heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,220,734; U.S. Pat. No. 4,702,016; U.S. Pat. No. 5,519,949; U.S. Pat. No. 4,813,641; U.S. Pat. No. Des. 335,008; and U.S. Pat. No. 5,024,408.

While these devices fulfill their respective, particular objectives and requirements, the aforementioned patents do not disclose a new shoe holder for attaching a shoe to a dryer. The inventive device includes a piece of material being adapted to fasten about a sole of a shoe; and also includes fastening members for fastening the piece of material about the sole of the shoe; and further includes dryer attachment members securely attached to the piece of material and being adapted to detachably attach to a drum of a dryer.

In these respects, the shoe holder for attaching a shoe to a dryer according to the present invention substantially departs from the conventional concepts and designs of the prior art, and in so doing provides an apparatus primarily developed for the purpose of preventing the tennis shoes from banging in the drum of the dryer while being dried.

SUMMARY OF THE INVENTION

In view of the foregoing disadvantages inherent in the known types of shoe pocket for a dryer now present in the prior art, the present invention provides a new shoe holder for attaching a shoe to a dryer construction wherein the same can be utilized for preventing the tennis shoes from banging in the drum of the dryer while being dried.

The general purpose of the present invention, which will be described subsequently in greater detail, is to provide a new shoe holder for attaching a shoe to a dryer which has many of the advantages of the shoe pocket for a dryer mentioned heretofore and many novel features that result in a new shoe holder for attaching a shoe to a dryer which is not anticipated, rendered obvious, suggested, or even implied by any of the prior art shoe pocket for a dryer, either alone or in any combination thereof.

To attain this, the present invention generally comprises a piece of material being adapted to fasten about a sole of a shoe; and also includes fastening members for fastening the piece of material about the sole of the shoe; and further includes dryer attachment members securely attached to the piece of material and being adapted to detachably attach to a drum of a dryer.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will. appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark. Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shoe holder for attaching a shoe to a dryer which has many of the advantages of the shoe pocket for a dryer mentioned heretofore and many novel features that result in a new shoe holder for attaching a shoe to a dryer which is not anticipated, rendered obvious, suggested, or even implied by any of the prior art shoe pocket for a dryer, either alone or in any combination thereof.

It is another object of the present invention to provide a new shoe holder for attaching a shoe to a dryer which may be easily and efficiently manufactured and marketed.

It is a further object of the present invention to provide a new shoe holder for attaching a shoe to a dryer which is of a durable and reliable construction.

An even further object of the present invention is to provide a new shoe holder for attaching a shoe to a dryer which is susceptible of a low cost of manufacture with regard to both materials and labor, and which accordingly is then susceptible of low prices of sale to the consuming public, thereby making such shoe holder for attaching a shoe to a dryer economically available to the buying public.

Still yet another object of the present invention is to provide a new shoe holder for attaching a shoe to a dryer which provides in the apparatuses and methods. of the prior art some of the advantages thereof, while simultaneously overcoming some of the disadvantages normally associated therewith.

Still another object of the present invention is to provide a new shoe holder for attaching a shoe to a dryer for preventing the tennis shoes from banging in the drum of the dryer while being dried.

Yet another object of the present invention is to provide a new shoe holder for attaching a shoe to a dryer which includes a piece of material being adapted to fasten about a sole of a shoe; and also includes fastening members for fastening the piece of material about the sole of the shoe; and further includes dryer attachment members securely attached to the piece of material and being adapted to detachably attach to a drum of a dryer.

Still yet another object of the present invention is to provide a new shoe holder for attaching a shoe to a dryer that eliminates the dryer door from being opened as result of the tennis shoes flying about the drum of the dryer.

Even still another object of the present invention is to provide a new shoe holder for attaching a shoe to a dryer that generally prevents expensive. tennis shoes from being damaged during the tumbling action of the drum of the dryer.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
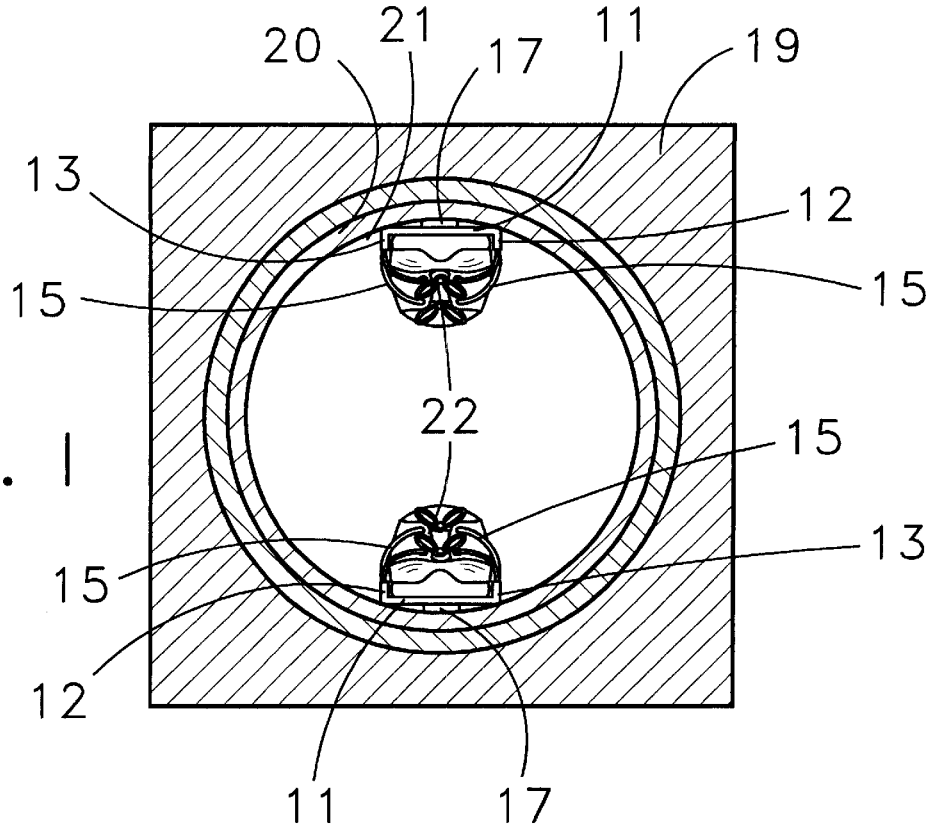
FIG. 1 is a side elevational view of a new shoe holder for attaching a shoe to a dryer according to the present invention and shown in use.
Figure 2:
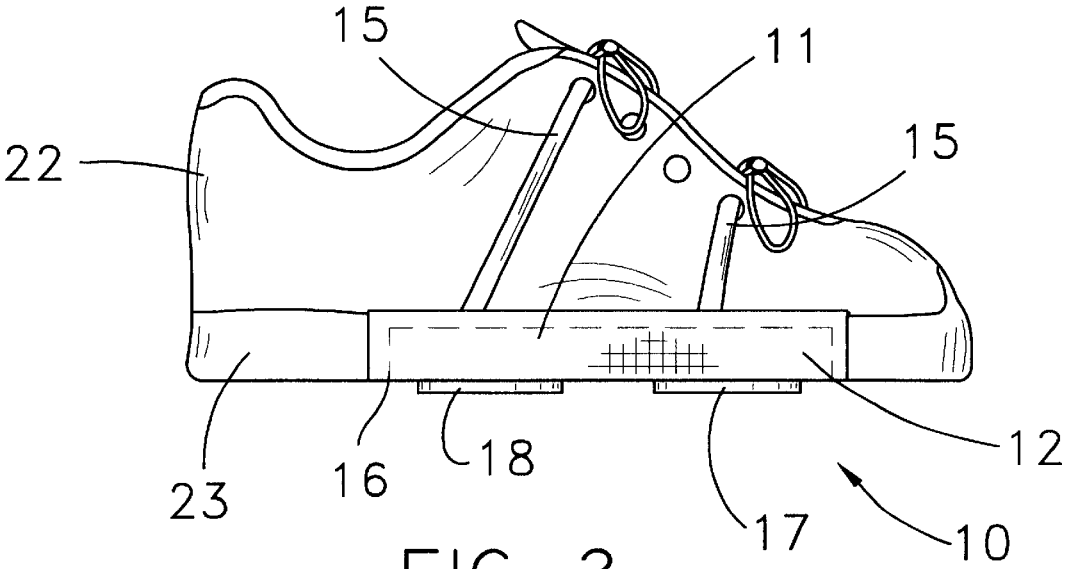
FIG. 2 is an edge elevational view of the present invention shown being attached to a shoe.
Figure 3:
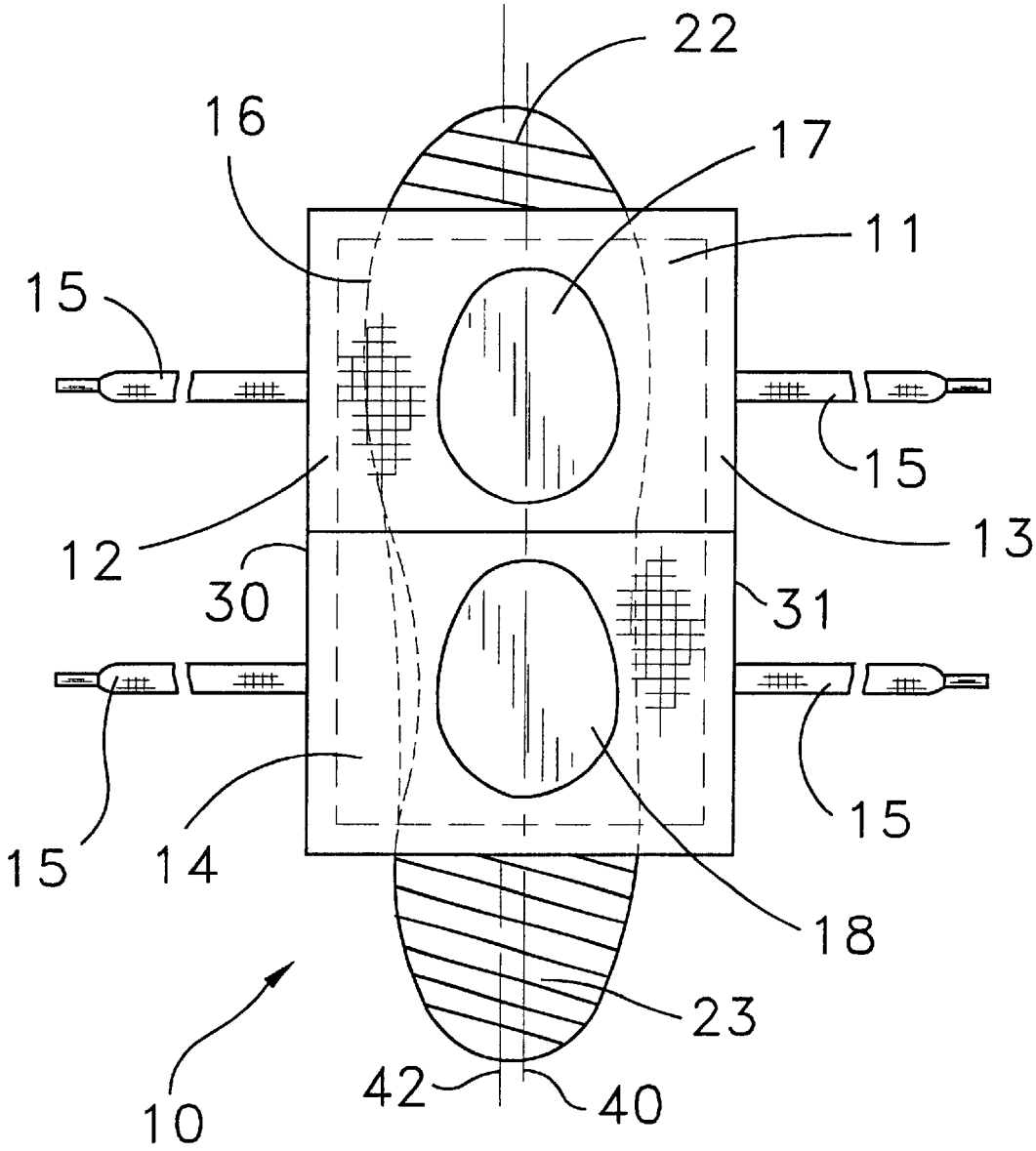
FIG. 3 is a side elevational view of the present invention shown being attached to a bottom of the sole of the shoe.

With reference now to the drawings, and in particular to FIGS. 1 through 3 thereof, a new shoe holder for attaching a shoe to a dryer embodying the principles and concepts of the present invention and generally designated by the reference numeral 10 will be described.

As best illustrated in FIGS. 1 through 3, the shoe holder for attaching a shoe to a dryer 10 generally comprises a piece of material 11 being adapted to fasten about a sole 23 of a shoe 22. The piece of material 11 has side end portions 12, 13 which are adapted to extend about sides of the sole 23 of the shoe 22 with the piece of material 11 having a bottom side 14 and with the piece of material 11 being essentially a rectangular piece of cloth. The piece of cloth has opposite sides edges 30, 31 (see FIG. 3). The piece of material may be elongate (see FIG. 3) and has a longitudinal axis 40 for orienting substantially parallel to a longitudinal axis 42 of the shoe to be mounted thereon.

The shoe holder for attaching a shoe to a dryer 10 also comprises fastening members 15, 16 for fastening the piece of material 11 about the sole 23 of the shoe 22. As a first embodiment, the fastening members 15, 16 include shoe laces 15 with a first pair of laces. Each of the first pair of laces 15 has a first end mounted on said piece of material (see, e.g., FIG. 3) at spaced locations on the piece of material on the opposite side edges. Further, each of the laces 15 has a free second end for inserting through an eyelet of the shoe to be mounted on the piece of material for securing the shoe to said piece of material (see, e.g., FIGS. 1 and 2). The fastening members may include a second pair of laces having first ends mounted on the piece of material. The first ends of the second pair of laces are mounted to the piece of material at spaced locations from the first ends of the first pair of laces, with the first ends of the second pair of laces each being mounted on opposite side edges at spaced locations on the opposite side edges from the first ends of the first pair of laces (see, e.g., FIG. 3). As a second embodiment, the fastening members is, 16 include hook and loop fasteners 16 being securely and conventionally attached to a top side of the piece of material 11 and being adapted to be securely and conventionally attached to the sole 23 of the shoe 22.

Dryer attachment members 17, 18 are securely and conventionally attached to the piece of material 11 and are adapted to detachably attach to a drum 20 of a dryer 19 with the dryer attachment members 17, 18 being securely attached to the bottom side 14 of the piece of material 11. The dryer attachment members 17, 18 are essentially magnets which are spaced apart with the magnets being essentially disc-shaped. The pair of magnets may be spaced in a direction of the longitudinal axis 40 of the piece of material (see FIG. 3).

In use, the user fastens the piece of material 11 about the sole 23 of the tennis shoe or sneaker 22 using either the shoe laces 15 [of the shoe] 22 or hook and loop fasteners 16 with the magnets 17,18 being disposed outwardly from the bottom of the sole 23. The user then takes the shoe 22 and attaches the magnets 17,18 to the interior of the wall 21 of the drum 20 inside the dryer 19 with the shoe 22 being securely attached to the wall 21 so that the shoe 22 cannot tumble about the drum 20 as it rotates during drying of the shoe 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A shoe holder for attaching a shoe to a dryer comprising:

a piece of material being adapted to fasten about a sole of a shoe, said piece of material having side end portions which are adapted to extend about sides of the sole of the shoe with said piece of material having a bottom side, said piece of material being essentially a rectangular piece of cloth;

fastening members for fastening said piece of material about the sole of the shoe; and dryer attachment members securely attached to said piece of material and being adapted to detachably attach to a drum of a dryer, said dryer attachment members being securely attached to said bottom side of said piece of material;

wherein said fastening members includes a first pair of laces, each of said laces having a first end mounted on said piece of material at spaced locations on said piece of material, each of said laces having a free second end for inserting through an eyelet of the shoe to be mounted on said piece of material for securing the shoe to said piece of material; said fastening members including a second pair of laces having first ends mounted on said piece of material, said first ends of said second pair of laces being mounted to said piece of material at spaced locations from said first ends of said first pair of laces;

wherein said piece of cloth has opposite sides edges, the first ends of said first pair of laces each being mounted on opposite said side edges, the first ends of said second pair of laces each being mounted on opposite side edges at spaced locations from the first ends of said first pair of laces;

wherein said piece of material is elongate and has a longitudinal axis for orienting substantially parallel to a longitudinal axis of the shoe to be mounted thereon, said dryer attachment member comprising a pair of magnets spaced in a direction of the longitudinal axis of said piece of material.

* * * * *